United States Patent [19]

Sarda

[11] Patent Number: 5,010,816

[45] Date of Patent: Apr. 30, 1991

[54] WEB TENSIONING DEVICE FOR PRINTING PRESS

[76] Inventor: Jean-Claude Sarda, 48 Avenue Claude Vellefaux, Paris, France, 75010

[21] Appl. No.: 269,861

[22] Filed: Nov. 10, 1988

[30] Foreign Application Priority Data

Nov. 12, 1987 [FR] France ..... 87 15614

[51] Int. Cl.[5] ..... B41F 13/02; B65H 20/12

[52] U.S. Cl. ..... 101/228; 101/232; 226/143; 226/195; 400/618

[58] Field of Search ..... 101/228, 232, 217, 218, 101/219; 400/618, 627; 226/143, 195

[56] References Cited

U.S. PATENT DOCUMENTS

| | | | |
|---|---|---|---|
| 2,927,789 | 3/1960 | Walsh et al. | 101/228 |
| 3,548,747 | 12/1970 | D'Amato | 226/143 X |
| 4,742,772 | 5/1988 | Grose | 101/228 X |
| 4,747,347 | 5/1988 | McAnelly | 101/228 X |
| 4,751,879 | 6/1988 | Van Pelt | 101/228 |
| 4,775,087 | 10/1988 | Moser et al. | 101/228 X |
| 4,815,376 | 3/1989 | Sarda | 101/228 X |

*Primary Examiner*—Clifford D. Crowder
*Attorney, Agent, or Firm*—James E. Bradley

[57] ABSTRACT

A printing press of a type that will operate with a continuous web has a device for taking up slack between the printing of each format. An electrically actuated sprocket drive is located at the opposite region for pulling the web forward from a blanket cylinder and press cylinder. A tube locates below the web in the input region. The tube has apertures and is connected to a continuous source of vacuum. The vacuum applies a force to cause the web to adhere to the tube. A web tightener will move the tube when pressure between the press and blanket cylinders releases. As the tube reaches the end of the web tightening position, the web tightener will expose a portion of the apertures to the atmosphere, bleeding off the vacuum.

9 Claims, 10 Drawing Sheets

WEB TENSIONING DEVICE FOR PRINTING PRESS

BACKGROUND OF THE INVENTION

1. Field of the Invention:

This invention relates in general to printing presses, and specifically to devices for selective printing on single sheets or a continuous web.

2. Description of the Prior Art:

Continuous printings are carried out on very large printing units which because of their high work rates are suitable for large print runs, since the operating means are entirely out of proportion to the printing of small runs. Moreover, increasingly rapid development of micro-information processing and the reduction in its production costs mean that many companies of medium size are becoming computerized. This has created new needs for printed matter printed continuously in small and medium runs, which cannot be satisfied by traditional printers, most of whom are equipped with sheet-fed presses.

A certain number of manufacturers of small offset presses, such as AB Dick, AM Multigraphics U.S.A., and Rotaprint Germany are aware of this new market and are beginning to manufacture, in relatively small series, equipment which is better suited to this demand, in which the sheet feed has been replaced by a continuous feed based of known means. However, their lack of versatility added to the fact that their prices, as compared with similar sheet-fed equipment, are substantially three times higher make them difficult to redeem at the present state of development of this new process. Furthermore, these presses are designed only for printing forms or labels intended for information processing and cannot handle printed matter in a continuous web not equipped with "Caroll" perforations, because their web-drawing and margin-locating systems are linked to the holes of these perforations.

Therefore, there is an enormous market in the sector of printing from a non-perforated web in small and medium runs, such as, for example, labels, which is completely out of reach of the traditional printer who possesses only sheet-fed offset printing presses.

SUMMARY OF THE INVENTION

The present invention relates to a printing press capable of feeding and receiving either single sheets or a continuous web to be printed and folded or rewound on a reel, depending on its intended use. These devices can be incorporated in sheet-fed printing presses generally of the offset variety during their manufacture, making it possible for them to print equally sheet by sheet or in a continuous web, or in presses of the continuous web type intended solely for continuous printing. These same devices can also take the form of an attachment on existing presses.

The objects and general characteristics of the invention are now set forth.

(1) In contrast with offset printing presses adapted for printing forms from a prefolded blank web perforated with "Caroll" holes, or with attachments fitted on sheet-fed offset presses, the offset presses or attachments of the present invention have a single drawing member performing the following triple functions: first, driving the web delivered by the press during printing; second, accurately positioning the web at each printing cycle; third, directly feeding the printed web into the rocker of the folder before reception.

(2) Also in contrast with offset printing presses adapted for printing forms or with attachments fitted on sheet-fed offset presses, the presses of the present invention by virtue of their design can, in addition to operating by sheet feed, operate on either a prefolded and "Caroll"-perforated web or a web delivered without perforations from a reel.

(3) One main characteristic of the invention is a unique tension device, which retracts the web at each printing cycle, making it possible to obtain an excellent register and, if appropriate, full-size printing of the printed matter to be handled. Within the scope of the invention, this web retraction device is preferably obtained by using the same pneumatic and mechanical means as those conventionally used for feeding the sheet-fed printing press.

It is clear that making dual use of essential members on a sheet-fed press for feeding in both a sheet-fed and continuous web versions is a favorable technical solution, making it possible to offer a press of several versions at a low cost.

The sole member for drawing and positioning the web is located at the printing outlet. This is contrary to all the other presses and attachments where the drawing and positioning member is on the inlet side of the press, thus making it necessary to use a second drawing member for feeding the folder. The use of a pneumatic system for relaying on and for holding the web underneath in a flexible way makes it possible to avoid stressing the holes and to print models, such as envelopes glued to a web, easily at a high rates (6 to 8000 copies per hour). It also avoids the use of a flexible tension loop formed by a roller, of which the virtually inevitable rebound causes inaccuracy of the register, a breakage of the web and the impossibility of handling envelopes of similar printed matter.

Moreover, considerable cost-savings are achieved by eliminating one set of drawing devices, its power electronics, and a stepping motor, representing a savings of approximately 35% to 40% on the total cost of the entire equipment for feeding the press from a continuous web.

(4) A folder provides to-and-fro movement of the rocker economically by means of a simple electromagnet working in phase with the press.

(5) A delivery table is provided with an upper stack level which automatically remains constant as a result of a balancing and compensation of the weight of the stack. This simple system is amply sufficient for most small presses.

These various elements makes it possible cost-effectively to provide simple presses or adaptations which are coherent and of an effectiveness suitable for intensifying the development of this market to the full extent.

The above as well as additional objects, features, and advantages of the invention will become apparent in the following detailed description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INvENTION

The invention, as defined in the claims, and the advantages obtained by means of this invention will emerge from the description of one of the embodiments adopted for putting the invention into practice, with reference to the accompanying drawings.

Figure 1:
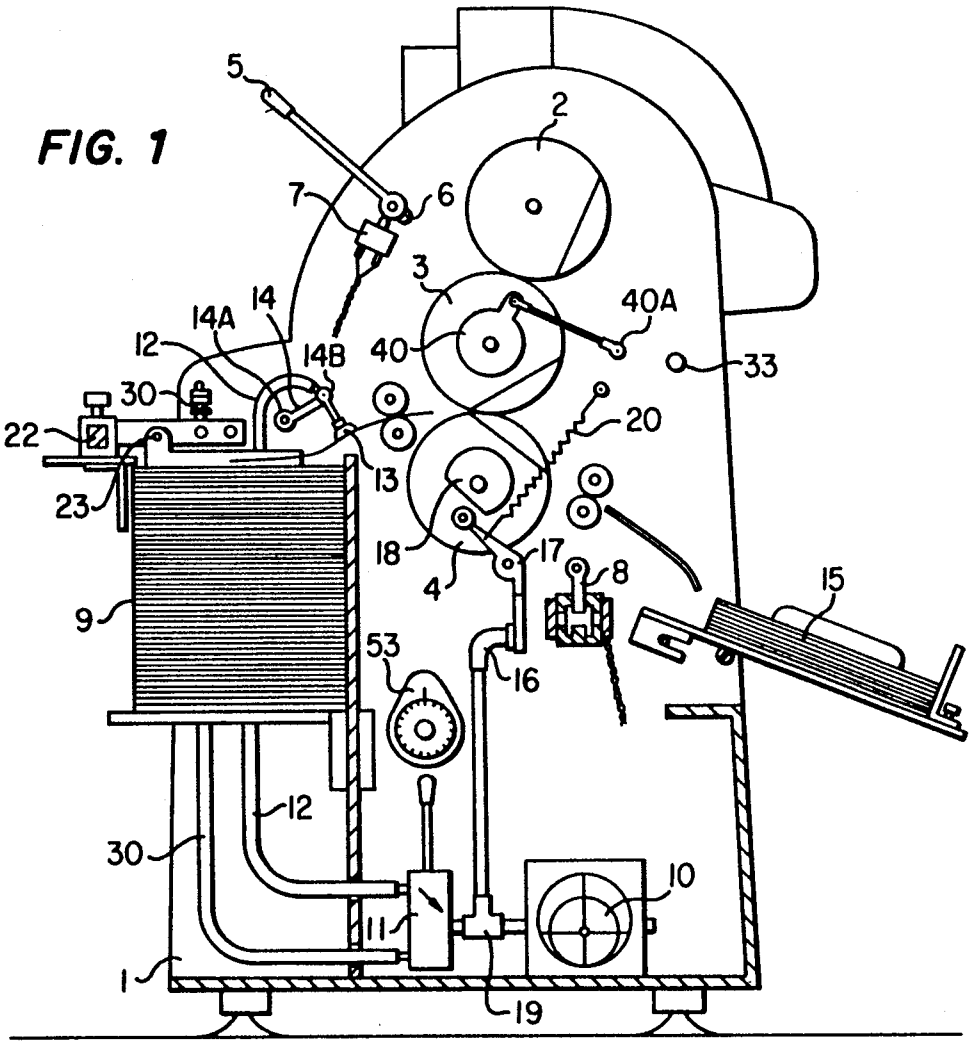
FIG. 1 shows a front view of a composite printing press in a sheet-fed printing configuration with all the non-removable accessories necessary for continuous printing.

FIG. 1 shows a front view of a composite printing press in a sheet-fed printing configuration and equipped with all the non-removable accessories necessary for continuous printing. The stand 1 supports the bearings of the plate cylinder 2, of the blanket cylinder 3 and of the press cylinder 4. The single control lever 5 selects the operating mode of the press, namely position A for the idle rotation of the press, position B for supplying the ink and water to the ink and water dispensing system, position C for the inking of the plate, position D for the transfer of the plate to the blanket, and position E for the take-up of paper and for subjecting the machine to pressure for printing. The single control lever 5 has a cam 6 which, together with the microswitch 7 and the electromagnet 8, allows the press to be put under pressure only in the printing position, the electromagnet 8 acting directly on the pressure-locking mechanism of the press cylinder 4.

A mechanical and pneumatic assembly makes it possible to take each sheet separately from the stack 9 one by one. The vacuum pump 10 sucks via the one-way bidirectional distribution valve 11. The flexible hose 12 conveys the vacuum to the suction cups 13 which, by means of the toggle lever 14 articulated on the axle 14A and the suction pipe 14B. Suction cup 13 seeks the sheet on the stack 9 in order to engage it into the press cylinder 4 which will print it and then push it on to the printed stack 15. The sheet is released from the suction cup 13 in the return movement of the toggle lever 14 by means of the valve 16 which is opened by operating the lever 17 actuated by the cam 18 appropriately wedged in the operating cycle of the press. The opening of the valve 16 connects the suction of the vacuum pump lo to the atmosphere via the connecting tee 19, thus cancelling the vacuum in the suction, Cups 13. The restoring spring 20 keeps the lever 17 of the valve 16 set at closure when the cam 18 allows.

Figure 2:
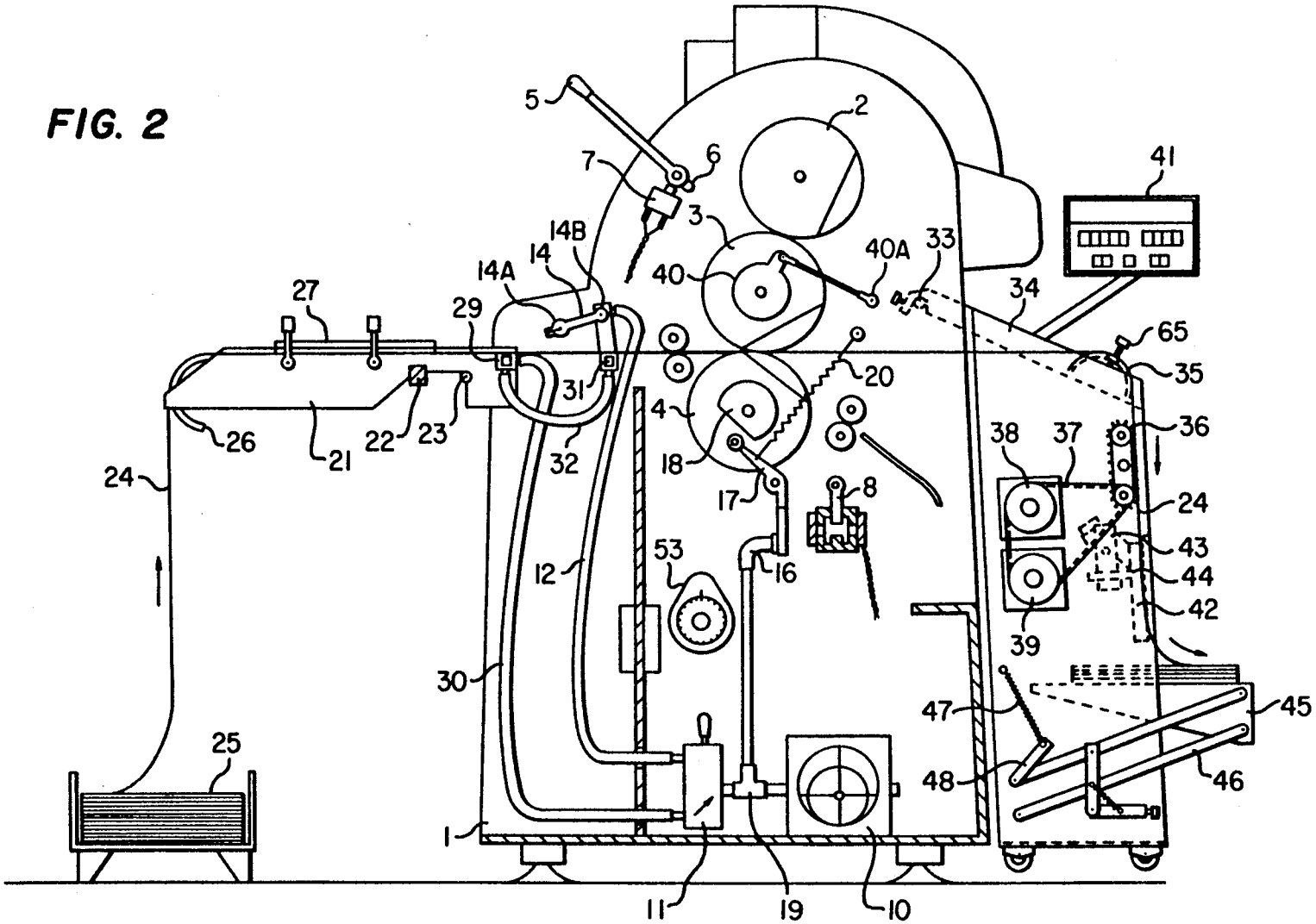
FIG. 2 shows a front view of the composite printing press of FIG. 1 in a continuous-printing configuration for forms equipped with Caroll holes.
Figure 3:
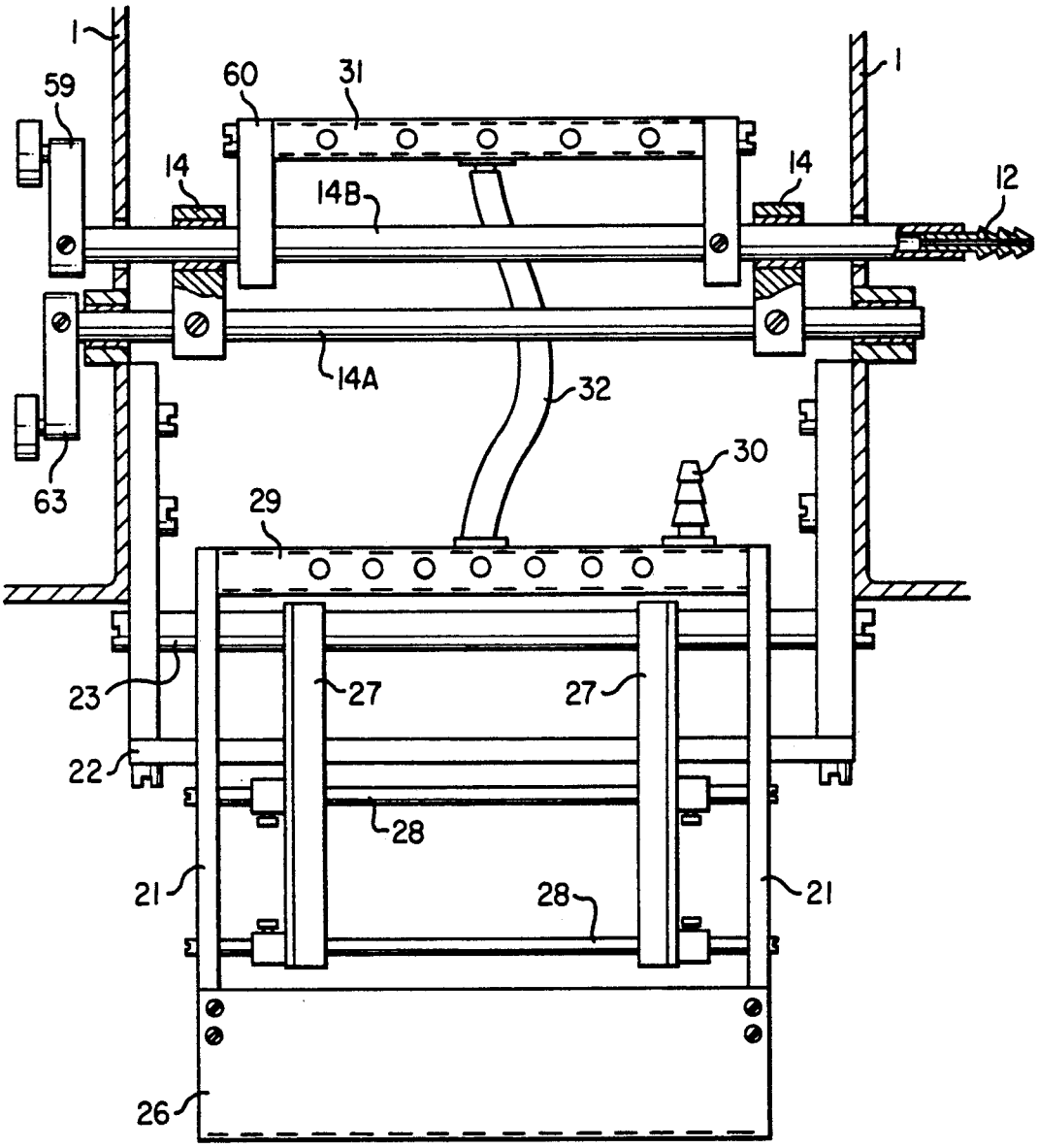
FIG. 3 shows a plan view of the removable module for the feed and advancing of the continuous web.
Figure 4:
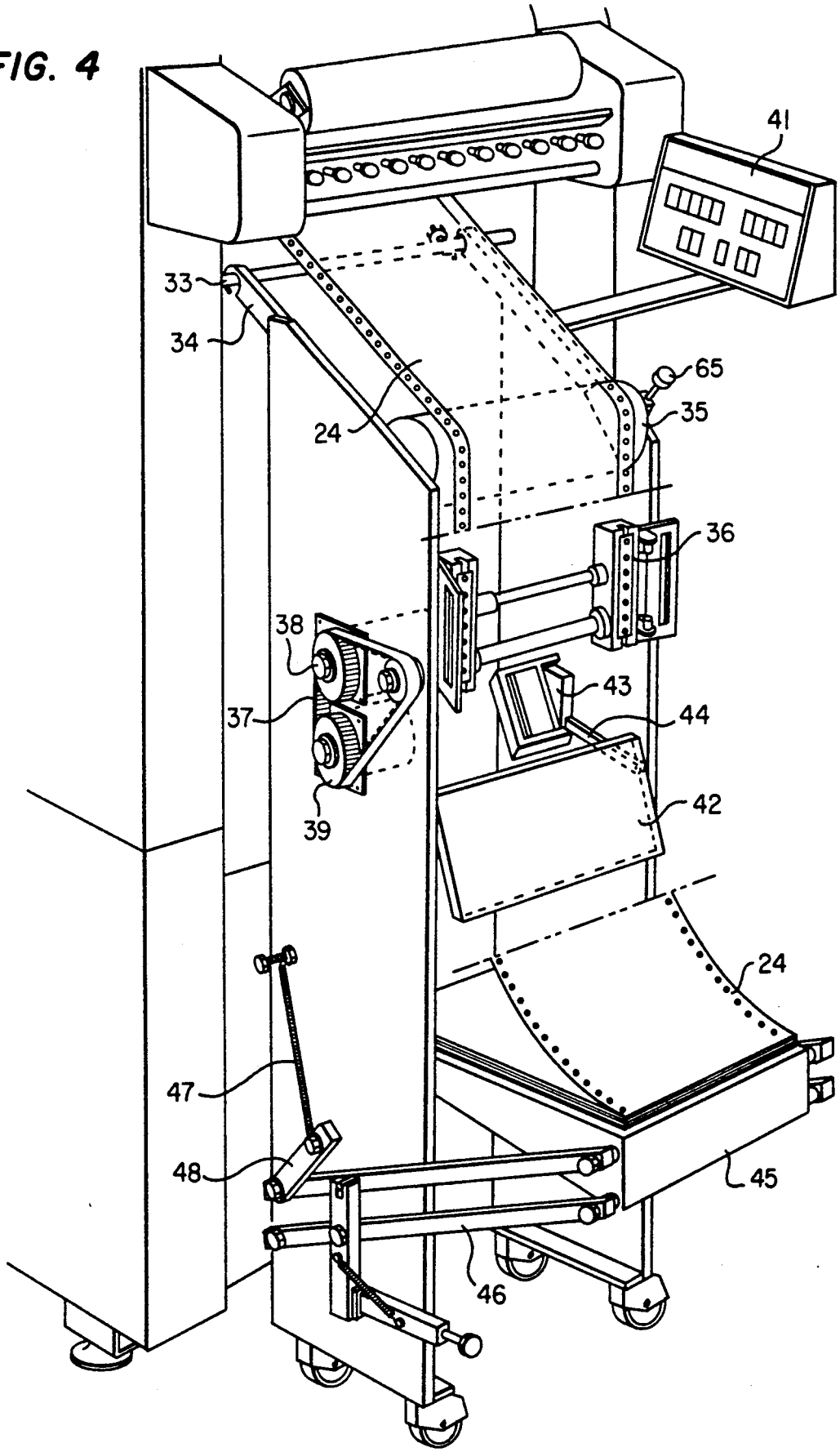
FIG. 4 shows a perspective view of the removable module of FIG. 3 for drawing and positioning the continuous web.

FIG. 2 shows a front view of the same composite printing press in a continuous-printing configuration for forms equipped with "Caroll" holes. A removable mechanical frame 21 is attached to the supports 22 and 23 of the margin stocks of the sheet feed, which are not used. The web 24 is delivered from the prefolded stack 25 to the slide 26 which orients it between the lateral positioning brackets 27. The guide rods 28 (FIG. 3) keep in place the brackets 27 set apart according to the width of the web to be printed.

The stationary slide tube 29 having suction holes is connected through flexible hose 30 to the vacuum pump 10 (FIG. 1) by means of the suitably oriented distribution valve 11. The web 24 is thus braked slightly and stabilized effectively in the course of its run during printing. In the same way, the movable slide tube 31 has holes and is connected to the suction system by means of the connecting pipe 32. It should be noted that, by means of the distribution valve 11, the slides 29 and 31 are permanently under suction when the vacuum pump 10 is in operation. The web to be printed passes through the process between the blanket cylinder 3 and the press cylinder 4.

A removable frame 34 (FIG. 2) is located on the opposite side of the blanket cylinder 3 and press cylinder 4 and attached to the spacer 33. A movable slide 35 orients the web 24 towards the sprocketed drawing devices 36 driven by a toothed belt 37 and the stepping motor 38 associated with the "format" pulse generator 39 and with a "speed" pulse generator 40 coupled directly to the axle of the cylinder and blocked in terms of rotation by the anti-torque rod 40A in order to indicate the speed of the printing machine and give a "start" signal at each printing cycle.

The electronic box 41 manages all the data, the format of the printed matter, the number of printings before the stopping of the press, and the information of the pulse generators 39 and 40. The printing web 24 drawn by the drawing devices 36 is engaged into the rocker tube 42 which will oscillate in the direction of folding, driven by the motor 43 and its connecting rod 44, to allow it to fold down onto the delivery plate 45. The latter, kept horizontal by the double parallelograms 46, progressively descends as a function of the weight of the folded paper, this weight being compensated by the action of the suitably calibrated spring 47 on the lever 48 blocked in position on one of the axles of the parallelogram 46.

The web to be printed 24 (FIG. 2) is put in place between the guide brackets 27 and then passes over the suction slides 29 and 31 in order to pass the printing press between blanket cylinder 3 and press cylinder 4. The web to be printed 24 winds around the slide 35 and is then hooked in the sprocketed drawing devices 36, before being engaged in the folding rocker 42, in order to be deposited on the delivery plate 45.

Figure 7:
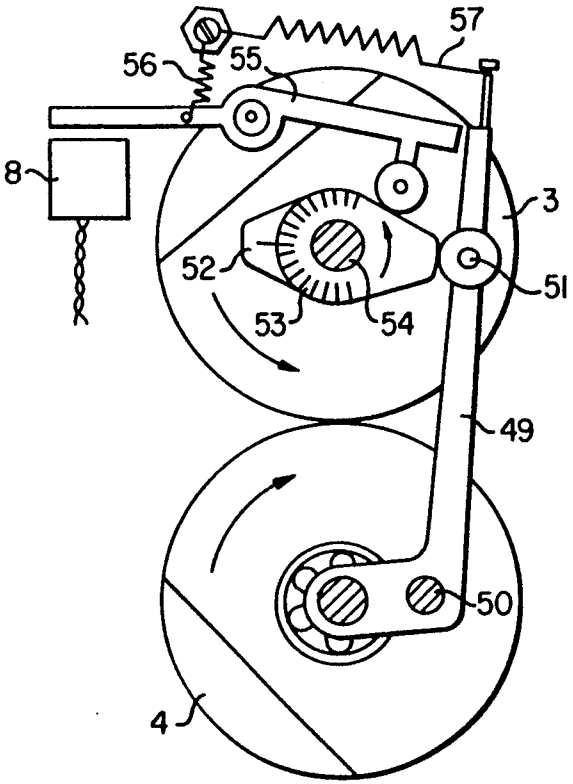
FIG. 7 shows the device for adjusting the pressure deactivation during a printing cycle.

At the start of operation, the press rotates idly to ensure that ink and water is supplied to the ink and water dispensing system. Since the single control lever 5 is not put in the printing position, the electromagnet s is live via the microswitch 7 closed and controlled by the lever 5 which thus does not allow the pressurizing of the blanket cylinder 3 and press cylinder 4 to be maintained. In fact, in the proposed example, the press cylinder 4 is mounted rotatably on a set of two bent levers 49 as shown in FIG. 7, articulated on two pivots 50 fastened to the press stand. This lever 49 carries a roller 51 rolling alternately on the stationary pressurizing cam 52 and the adjustable depressuring cam 53. These two cams are suitably wedged on the axle 54 of the blanket cylinder 3. The pressurizing cam 52 pushes the roller 51 of the lever 49 when both the recesses of the cylinders 3 and 4 are opposite one another.

If the electromagnet 8 is live, the trigger lever 55 does not retain the lever 49 which therefore does not remain in the "pressure" position. If the electromagnet 8 is not live, the trigger lever 55 stressed by its restoring spring 56 slides under the end of the lever 49 which thus remains in the "pressure" position and makes printing possible. The release of the pressure is obtained by means of the cam 53 adjustable in terms of rotation as a function of the length of the format to be printed. This cam 53 first lifts the lever 49 and then pushes back the trigger lever 55 thus released, making it possible for the roller 51 to descend along the cam 53, thereby ensuring that the lever 49 restored by its spring 57 is put into the "depressurized" position.

In the "printing" position of the single control lever 49, the electromagnet 8 (FIG. 2) is therefore not live and the press cylinder 4 comes into the printing position When the recesses of the cylinders 3 and 4 have passed, the web to be printed 24 is gripped between the blanket of the blanket cylinder 3 and the press cylinder 4 and is driven, guided by the brackets 27 and stabilized by the suction slides 29 and 31. As the web 24 is advanced, the pulse generator 40 is driven synchronously with the blanket cylinder 3 to supply a signal which allows the stepping motor 38 to start. This same generator 40 permanently supplies pulses at a frequency proportional to the rotational speed of the printing press. These pulses serve directly for controlling the stepping motor 38 via the electronic box 41.

The suitably geared-down stepping motor 38 drives the sprocketed drawing devices 36 to the same linear speed as the circumferential speed of the blanket cylinder 3 and press cylinder 4, whatever the operating rate of the printing press. When the format to be printed has run through, the pulse generator 39 driven by the stepping motor 38 together with the sprocketed drawing devices 36 informs the electronic box 41 which stops the stepping motor 38 at the end of the format. At the same time, the "depressurizing" cam 53 releases the web 24 which stops in an inexact way.

Figure 8A:
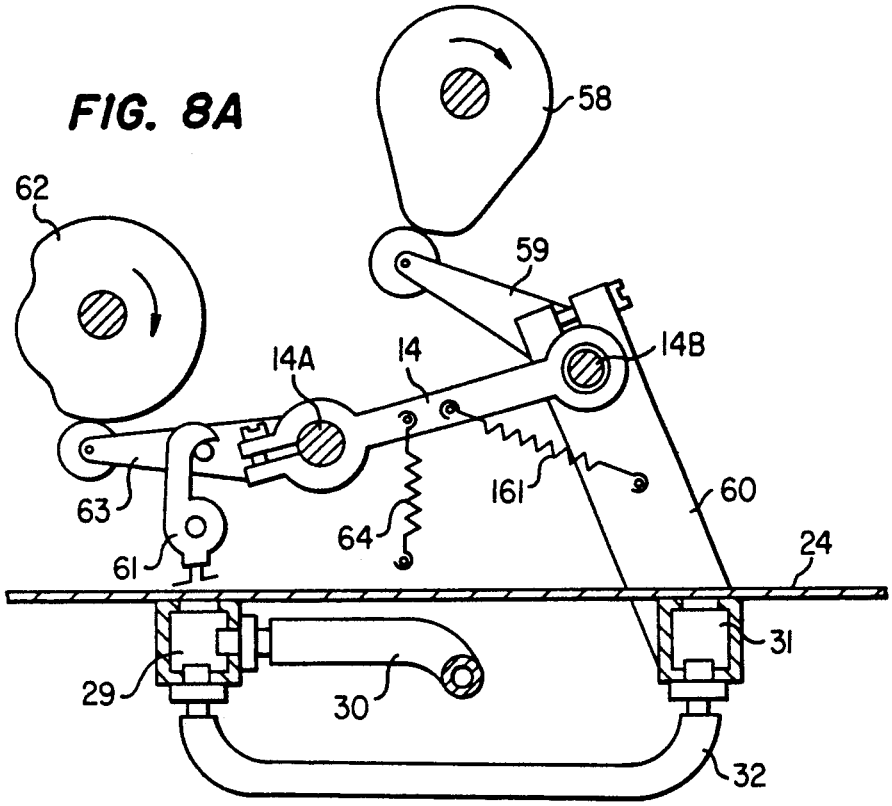
FIG. 8A shows a web tensioning means for tensioning the web constructed in accordance with this invention.
Figure 8B:
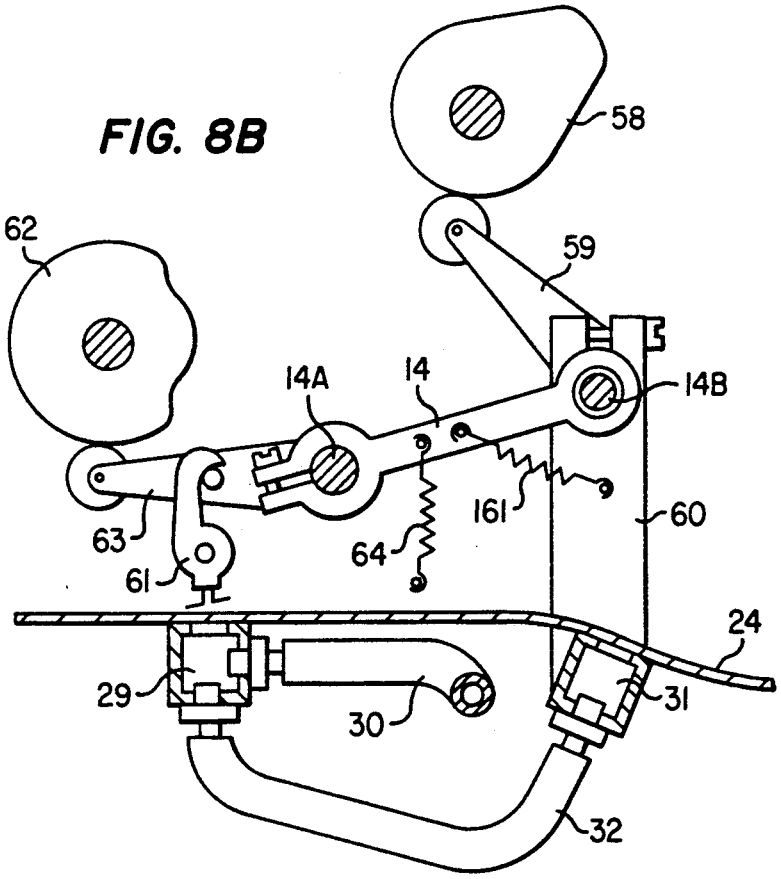
FIG. 8B shows the web tensioning means of FIG. 8A, and showing the web tensioning means in the process of taking up slack in the web.

In the printing cycle and after printing, the hollow shaft 14B normally carrying the suction cups 13 (FIG. 1) for sheet-fed printing, which are removed for continuous printing, rotates under the action of the cam 58 (FIGS. 8A, 8B) pushing the lever 59 on which it is keyed. Referring to FIGS. 8A and 8B, and also to FIG. 2, the slide tube 31 is rigidly mounted on a pair of levers 60, which in turn are mounted on shaft 14B for rotation therewith. Cam lever 59 is also mounted to shaft 14B for rotation therewith. Cam lever 59 has a roller or follower that engages cam 58 (FIGS. 8A and 8B). As the cam 58 rotates, cam lever 59 will move the levers 60 downward and rearward from the position shown in FIG. 8*a* to that shown in FIG. 8B. The slide tube 31 will move downward and rearward with the levers 60, taking up slack in the web 24 due to the vacuum being drawn by the slide tube 31.

Slack will occur at the conclusion of printing each format where the drawing device 36 (FIG. 2) draws for an increment that is less than the circumferential length that the press cylinder 4 and blanket cylinder 3 will engage each other. The press cylinder 4 and blanket cylinder 3 will draw more of the web 24 forward than is pulled by the tractor drawing device 36.

Because of the rotation of the levers 60, the slide tube 31 rotates a fractional amount in a forward direction. The forward upper edge of the slide tube 31 tilts downward. This results in the apertures in the top of the tube 31 inclining relative to vertical. Consequently, when the press and blanket cylinders 4, 3 (FIG. 2) begin pulling the web 24 again, the web 24 will easily pull loose from the slide tube 31 and locate above it until the slide tube 31 moves back to the position shown in FIG. 8A. The levers 60 and lever 59 serve along with cam 58 as linkage means for moving the slide tube 31 rearward relative to the press and blanket cylinders 4, 3, and for rotating the slide tube 31 a selected amount to place the apertures in a position inclined to vertical. During this movement, it drives the set of two levers 60 carrying the suction slide 31 which comes to adhere under the web 24. When the printing cycle continues, the cam 58 allows the lever 59 driving the slide 31 to return in the opposite direction. The web 24, held on the slide 31 by means of a vacuum, stretches until it is brought to a stop by the sprocketed drawing devices 36 (FIG. 2). The relaying-on of the web 24 at each printing cycle is thus obtained very simply, whatever the regularity of the length of the web, the possible differences being absorbed as a result of the sliding of the web on the slide 31 as soon as the paper is stretched. At the start of the next cycle, the drawing of the blanket cylinder 3 and press cylinder 4 detaches the web 24 from the slide 31, temporarily freeing it from the suction action. A spring 161 connects between each lever 60 and toggle lever 14. It should be noted that the levers 14 (FIG. 8) remain blocked in the raised position by the manually controlled catch 61, thus rendering inoperative the action of the cam 62 pushing the lever 63 blocked on the shaft 14A. Normally, this movement, together with that of the axle 14B allows to be taken from the stack 9 (FIG. 1), the sheets to be printed in the sheet-fed printing configuration, the lever 14 (FIG. 8) being returned by means of spring 64.

Figure 5:
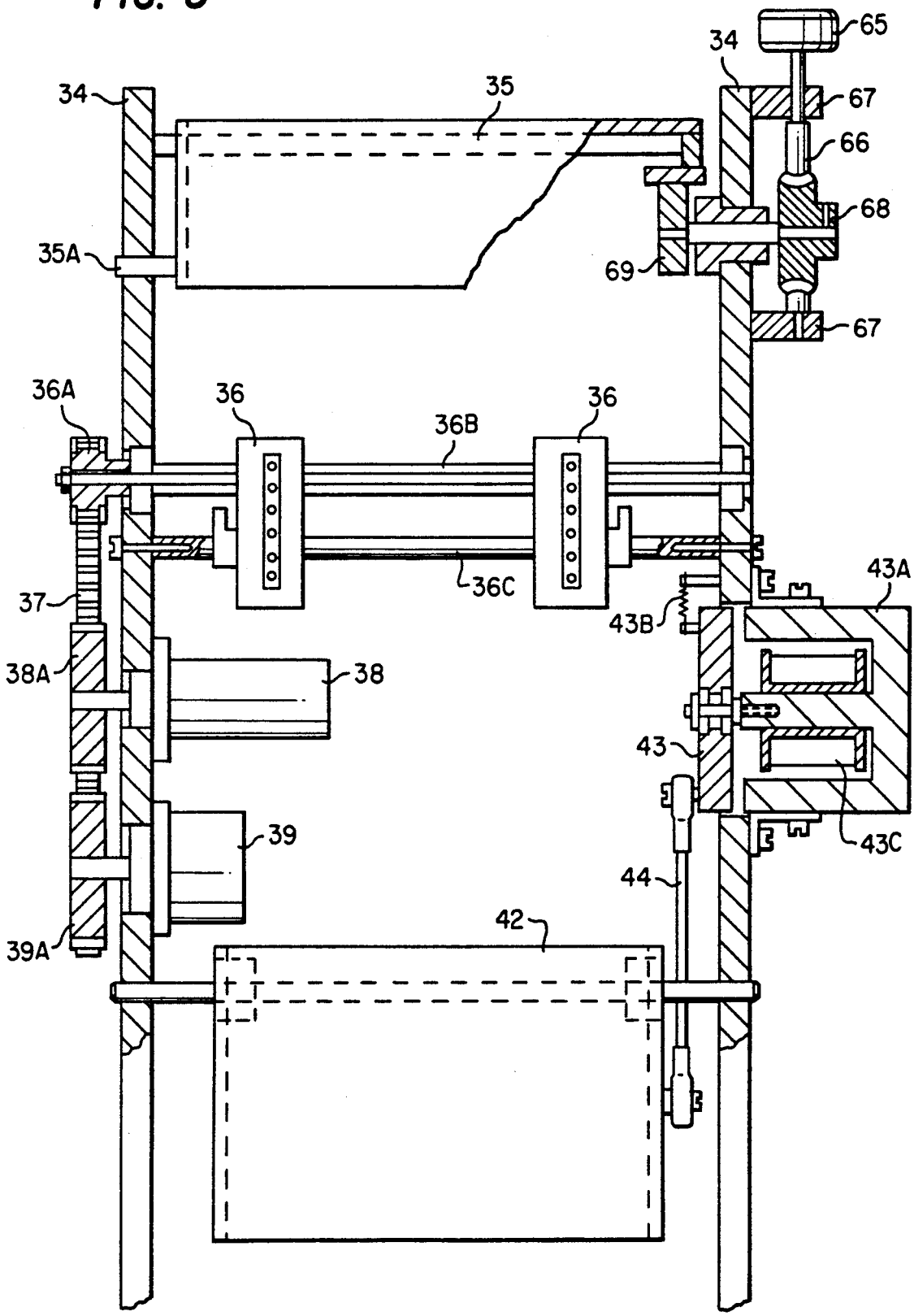
FIG. 5 shows a front view of the removable module of FIG. 4.
Figure 6:
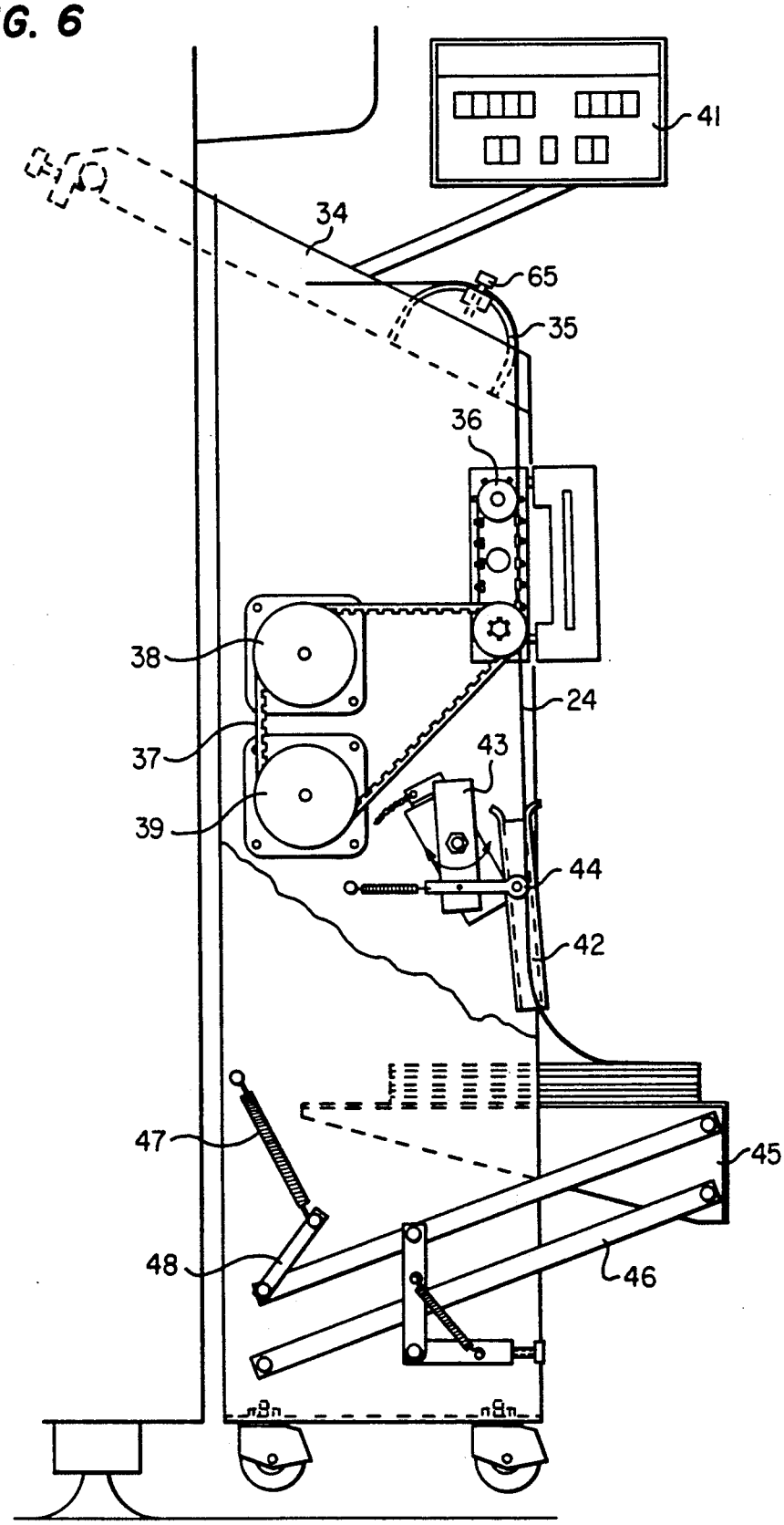
FIG. 6 shows a profile view of the removable module of FIG. 4.

The adjustment of the lateral margin is obtained micrometrically as a result of the movement of the brackets 27 (FIG. 3) together with the movement of the drawing devices 36 (FIG. 5). The adjustment of the longitudinal margin is obtained as a result of the movement of the web 24 by means of the stepping motor 38. Its positioning accuracy corresponds to the amount of movement which exists between two steps of the stepping motor 38. To obtain a continuous movement, the slide 35 is movable. It pivots on an axle 35A and bears on a cam 69 driven in rotation by the worm wheel 68. The latter is actuated by the shafted endless screw 66 carried by the bearings 67, the knurled knob 65 ensuring the execution of the operation.

Figure 9:
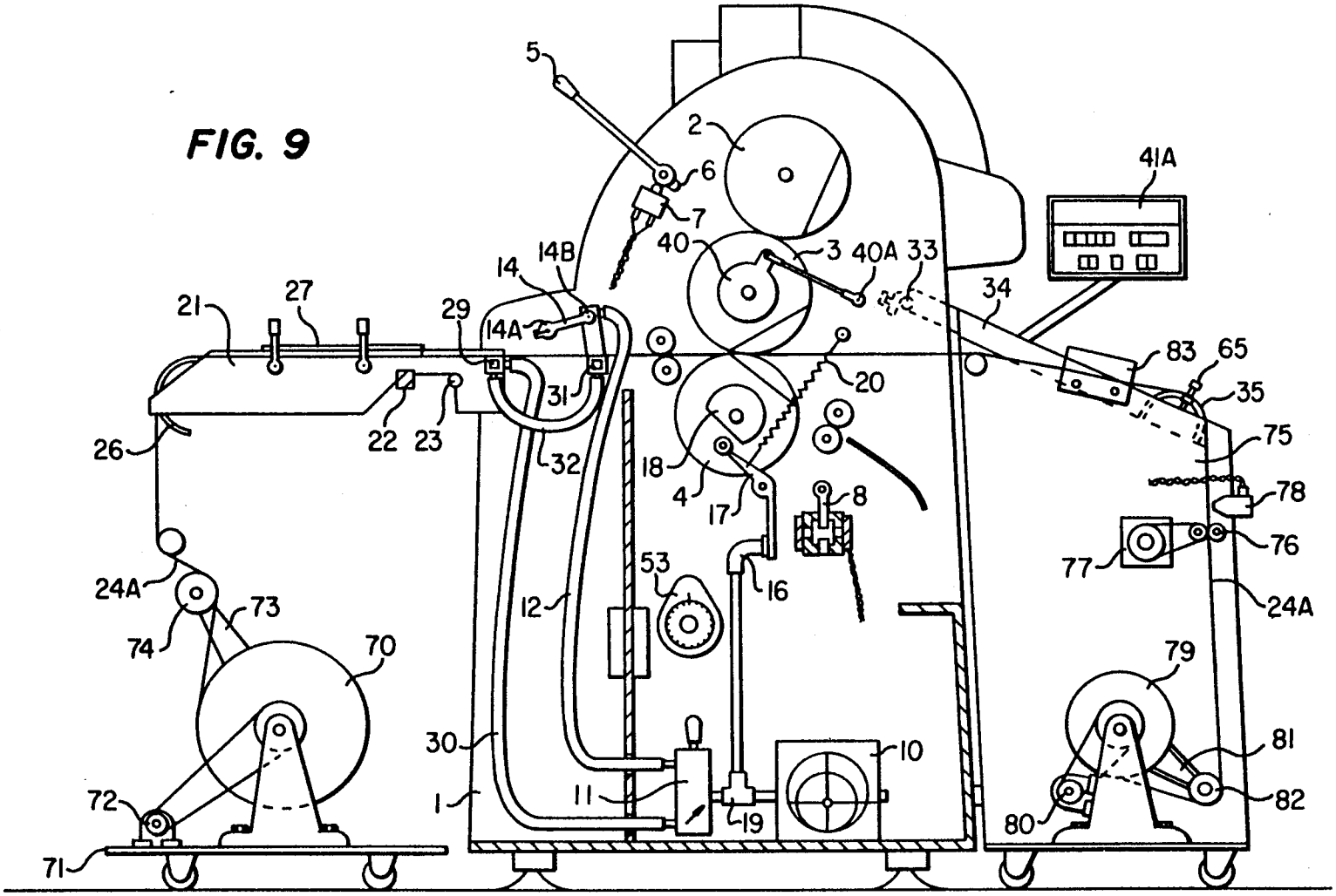
FIG. 9 shows the front view of the composite printing press in a continuous reel-to-reel printing configuration.

FIG. 9 shows a front view of the same composite printing press in a continuous reel-to-reel printing configuration. The reel 70 delivering the web to be printed 24A is installed on an unwinding device 71, the motor 72 of which is controlled by a control loop generated by the follower lever 73 associated with the roller 74. The feeder module composed of the removable frame 21 (FIG. 2) is associated with its guide and relaying-on elements functions in the same way as for printing in a web perforated with "Caroll" holes. The module 75 (FIG. 9) for drawing and positioning the web 24A has an adjustable slide 35 which orientates it in order to cause it to pass between two press rollers 76 driven by a direct-current motor 77, the rotation speed of which is controlled by the coder 40 associated with an electronic box 41A, in such a way that the circumferential speed of the press rollers 76 is equal to that of the blanket cylinder 3 and press cylinder 4. The printed web 24 is subsequently wound onto the winding wheel 79, the drive motor 80 of which is controlled by the control loop formed by the follower lever 81 associated with the winding roller 82.

As in the example of FIG. 2, the web to be printed 24A is driven by being gripped between the blanket cylinder 3 and press cylinder 4. As in the example of FIG. 2 and FIG. 7, the web to be printed 24A is released as a result of the pressure deactivation of the press as soon as the format has been printed and run off. When each printing is made, two reference marks are printed one after the other at a short distance of approximately twenty millimeters on the fringe of the web. The first reference mark passing under the adjustable reader 78 causes the motor 77 to change to a very low speed. The second signal supplied as a result of the passage of the second reference mark blocks the motor 77 in the stop position, thus immobilizing the printed web 24A. As in the example of FIG. 2, the feeder module composed of the removable module 21 associated with its guide and relaying-on-elements retracts the web to be printed 24A rearwards and stretches it on stand-by for the next printing. The lateral margin is obtained by the feeder 27 and the printing output 83 bracket. The movement of the adjustable reader 78 along the printed web 24A and the adjustment of the depressurizing cam 53 (FIG. 7) make it possible jointly to obtain the desired format.

Figure 10:
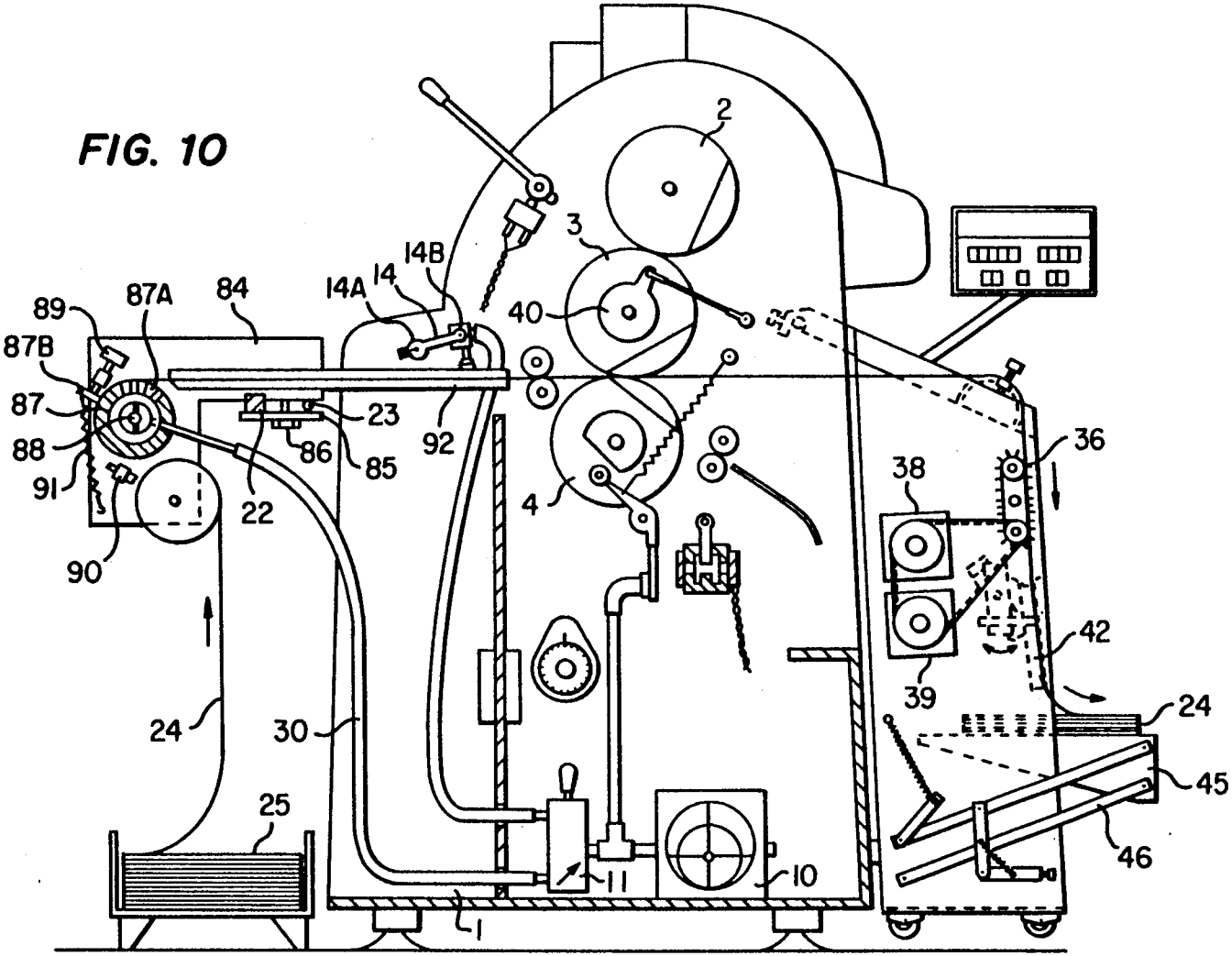
FIG. 10 shoWs, in alternate version of the invention, a front view of the second pneumatic advancing system.
Figure 11:
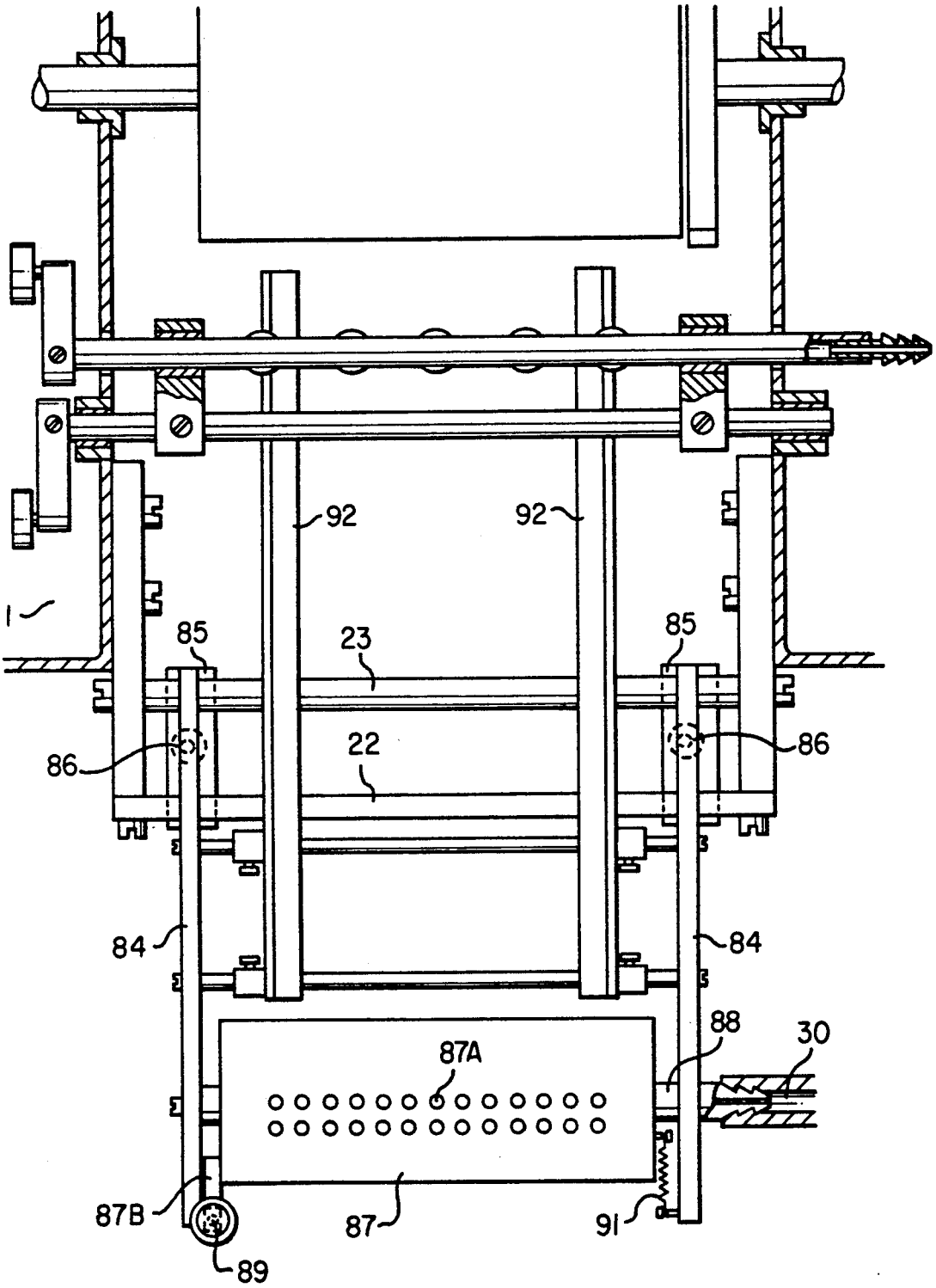
FIG. 11 shows a plan view of the alternate version of the invention of FIG. 10.

FIGS. 10 and 11 illustrate an alternate version of the invention. A frame 84 (FIG. 10) is placed on the spacers and 23 fastened to the printing press 1. The flanges 85 and screws 86 keep it firmly in position A feed drum 87 pivots about the stationary hollow shaft 88. Some rows of holes 87A made parallel to the generatrices of the feed drum 87 keep the continuous web 24 to be printed in place by means of the vacuum pump 10 which sucks continuously through the pipes 90 and 92 via the suitably oriented two-position valve 11. The movable dog 87B fastened to the feed drum 87 limits its rotary movement by coming to bear on the manually settable limit stop 89 and adjustable limit stop 90. The spring 91 constantly returns the feed drum 87 towards the adjustable stop 90.

During printing, the drawing devices 36 draw the continuous web 24 through the press 1 which, when it is under pressure, itself drives the continuous web 24 gripped between the blanket cylinder 3 and the press cylinder 4. The continuous web 24 laid against the feed drum 87 result of the vacuum generated by the vacuum pump 10 drives it in rotation, thereby tensioning the restoring spring 91 until the dog 87B is brought in contact with the stop 89. The manual setting of the stop 89 makes it possible to position the row of holes 87A in such a way that they are more or less exposed by the continuous web 24. The air penetrating slightly into the feed drum 87 reduces the vacuum, and the continuous web 24 begins to slide on the feed drum 87 immobilized by the stop 89.

At the end of printing, the drawing devices 36 stop, after the desired format has been run off. The pressure deactivation of the press is set so that the latter delivers a little more web than the printing format to be produced, to be sure that the entire format has been printed. The released pressure instantaneously cancels the drive of the printed continuous web 24. The latter, released, is returned rapidly rearwards before the next printing by the feed drum 87, the suction holes 87A of which have been reclosed immediately as a result of the opposite rotary movement attributed to the restoring spring 91. The continuous web 24, once again firmly held and, when stopped in its rearward movement, drawn against the feed drum 87 as a result of the suction of the vacuum pump 10, is thus stretched and relayed, being retained by the stop-positioning drawing devices 36. The feed drum 87 and the continuous web 24 together provide as it were a rotary valve, of which the valve body is a continuous web 24 and rotating plug is the perforated feed drum 87. The cylinder allows efficient winding of the continuous web 24 round the feed drum 87. The lateral slides 92 ensure good guidance and lateral laying-on of the continuous web 24 through the press 1.

In summary, in order to function, the relaying-on devices used, in combination, the driven continuous web 24, the vacuum pump 10 of the press 1, a restoring spring 91 driving rearwards the rotary feed drum 87 equipped with a dog 87B coming to bear on the settable stop 89 in order to limit its angular movement and generate an air leak proportionable as a function of a continuous web 24 to be processed, and a conventional member 36 for drawing and positioning the web.

An alternative version of the invention can be provided for the sake of economy and, for example, when a press of the same type intended solely for continuous printing to be produced.

In this version, the feed drum is neither perforated nor fed by means of a vacuum pump, but is covered with a semi-hard covering, and the adhesion of the web on the feed drum, necessary for its functioning, is imparted by the slight pressure of a roller or rollers mounted freely in the direction of run of the web and retained by means of an oppositely directed free wheel. Preferably, the means described in order to illustrate the invention will be adopted, because the pneumatic relaying-on principle, according to which action is taken solely under the web, allows good effective and flexible control for the latter and consequently offers the possibility of processing continuous webs at a high rate.

Where the production of presses intended only for continuous printing is concerned, it is quite clear that the vacuum pump in this case only performs the function of subjecting the feed drum 87 (FIG. 10) which is the subject of the invention to a vacuum. Without departing from the scope of the present invention, as regards machines of large format and according to the length of run of the continuous web, in some specific cases the restoring spring of the feed drum is replaced by a motor controlled by the "start/stop" information supplied by the control and regulating electronics of the stepping motors. It is quite clear that the same continuous-web feed mode which is the subject of the invention can be adapted to all offset or such like presses having an idle time between each successive printing cycle.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. In a printing press having a blanket cylinder and a press cylinder for printing on a continuous web that is drawn from an input region on an input side of the blanket cylinder and press cylinder to an output region on an opposite side of the input region, the press having pressure releasing means for releasing pressure between the blanket cylinder and press cylinder after printing each format, an improved feed and drive mechanism for conveying the web from the input region to the output region, comprising in combination:

an electrically actuated drive means disposed at the output region for selectively pulling the web forward from the blanket cylinder and the press cylinder;

a tube at the input region for sliding contact with the web and having a sidewall containing a plurality of apertures;

vacuum means for continuously providing a vacuum to the tube both while the press and blanket cylinders are in a printing position and while in a released position;

web tightening means operable when the press and blanket cylinders are in the released position for moving the tube to a web tightening position to remove any slack in the web following the printing of each format, the vacuum in the tube applied to the web through the apertures causing the web to adhere to the tube during the movement to the web tightening position, and for exposing at least a portion of the apertures to atmosphere when the tub is in the web tightening position to relieve a portion of the vacuum applied to the web, allowing the web to be drawn forward over the tube by rotation of the press and blanket cylinders while in the printing position; and wherein the web tightening means comprises in combination:

a cam mounted to the press for rotation during rotation of the press and blanket cylinders;

a lever mounted to the tube; and cam follower means in rolling engagement with the cam and connected with the lever for moving the tube rearward and forward relative to the press and blanket cylinders as the cam rotates.

2. In a printing press having a blanket cylinder and a press cylinder for printing on a continuous web that is drawn from an input region on an input side of the blanket cylinder and press cylinder to an output region on an opposite side of the input region, the press having pressure releasing means for releasing pressure between the blanket cylinder and press cylinder after printing each format, an improved feed and drive mechanism for conveying the web from the input region to the output region, comprising in combination:

an electrically actuated drive means disposed at the output region for selectively pulling the web forward from the blanket cylinder and the press cylinder;

a tube at the input region for sliding contact with the web and having a sidewall containing a plurality of apertures;

vacuum means for continuously providing a vacuum to the tube both while the press and blanket cylinders are in a printing position and while in a released position;

web tightening means operable when the press and blanket cylinders are in the released position for moving the tube to a web tightening position to remove any slack in the web following the printing of each format, the vacuum in the tube applied to the web through the apertures causing the web to adhere to the tube during the movement to the web tightening position, and for exposing at least a portion of the apertures to atmosphere when the tube is in the web tightening position to relieve a portion of the vacuum applied to the web, allowing the web to be drawn forward over the tube by rotation of the press and blanket cylinders while in the printing position; and wherein the tube is oriented with the apertures facing upward while the press and blanket cylinders are in the printing position and wherein the web tightening means comprises:

linkage means for moving the tube rearward relative to the press and blanket cylinders and for rotating the tube a selected amount to place the apertures in a position inclined to vertical, whereby when the press and blanket cylinders begin to move the web forward again when the press and blanket cylinders are in the printing position, tension in the web will cause it to lift from the apertures to relieve the force of vacuum applied to the web.

3. In a printing press having a blanket cylinder and a press cylinder for printing on a continuous web that is drawn from an input region on an input side of the blanket cylinder and press cylinder to an output region on an opposite side of the input region, the press having pressure releasing means for releasing pressure between the blanket cylinder and press cylinder after printing each format, an improved feed and drive mechanism for conveying the web from the input region to the output region, comprising in combination:

an electrically actuated drive means disposed at the output region for selectively pulling the web forward from the blanket cylinder and the press cylinder;

a tube at the input region for sliding contact with the web and having a sidewall containing a plurality of apertures;

vacuum means for continuously providing a vacuum to the tube both while the press and blanket cylinders are in a printing position and while in a released position;

web tightening means operable when the press and blanket cylinders are in the released position for moving the tube to a web tightening position to remove any slack in the web following the printing of each format, the vacuum in the tube applied to the web through the apertures causing the web to adhere to the tube during the movement to the web tightening position, and for exposing at least a portion of the apertures to atmosphere when the tube is in the web tightening position to relieve a portion of the vacuum applied to the web, allowing the web to be drawn forward over the tube by rotation of the press and blanket cylinders while in the printing position; and wherein the web tightening means comprises:

means for mounting the tube rotatably to the press for causing it to rotate in a forward direction a selected distance as the web is drawn forward by the press and blanket cylinders while in the printing position; and spring means for urging the tube to rotate in a rearward direction when tension in the web is released as the press and blanket cylinders move to the released position, the vacuum applied to the web through the apertures causing the tube to draw the web in a rearward direction.

4. In a printing press having a blanket cylinder and a press cylinder for printing on a continuous web that is drawn from an input region on an input side of the blanket cylinder and press cylinder to an output region on an opposite side of the input region, the press having pressure releasing means for releasing pressure between the blanket cylinder and press cylinder after printing each format, an improved feed and drive mechanism for conveying the web from the input region to the output region, comprising in combination:

an electrically actuated drive means disposed at the output region for selectively pulling the web forward from the blanket cylinder and the press cylinder;

a tube at the input region for sliding contact with the web and having a sidewall containing a plurality of apertures;

vacuum means for continuously providing a vacuum to the tube both while the press and blanket cylinders are in a printing position and while in a released position;

web tightening means operable when the press and blanket cylinders are in the released position for moving the tube to a web tightening position to remove any slack in the web following the printing of each format, the vacuum in the tube applied to the web through the apertures causing the web to adhere to the tube during the movement to the web tightening position, and for exposing at least a portion of the apertures to atmosphere when the tube is in the web tightening position to relieve a portion of the vacuum applied to the web, allowing the web to be drawn forward over the tube by rotation of the press and blanket cylinders while in the printing position; and wherein the web tightening means comprises:

means for mounting the tube rotatably to the press for allowing it to rotate in a forward direction a selected distance as the web is drawn forward by the press and blanket cylinders while in the printing position as a result of adherence of the web to the tube because of the vacuum;

spring means for urging the tube to rotate in a rearward direction when tension in the web is released as the press and blanket cylinders move to the released position, the vacuum applied to the web through the apertures causing the tube to draw the web in a rearward direction;

stop means for limiting the amount of forward rotation of the tube; and wherein the apertures are positioned in the tube so that at least a portion will be exposed to atmosphere when the stop means stops the forward rotation of the tube.

5. In a printing press having a blanket cylinder and a press cylinder for printing on a continuous web that is drawn from an input region on an input side of the blanket cylinder and press cylinder to an output region on an opposite side of the input region, the press having pressure releasing means for releasing pressure between the blanket cylinder and press cylinder after printing each format, an improved feed and drive mechanism for conveying the web from the input region to the output region, comprising in combination:

an electrically actuated drive means disposed at the output region for selectively pulling the web forward from the blanket cylinder and the press cylinder;

a tube extending below the web at the input region for sliding contact with the web and having a plurality of apertures;

vacuum means for providing a vacuum to the tube;

linkage means for moving the tube rearward relative to the press and blanket cylinders while the press and blanket cylinders are in the released position to remove any slack in the web following the printing of each format, the vacuum in the tube applied to the web through the apertures causing the web to adhere to the tube during the rearward movement to the web tightening position; and wherein the web tightening means comprises in combination:

a cam mounted to the press for rotation during rotation of the press and blanket cylinders;

a lever mounted to the tube; and cam follower means in rolling engagement with the cam and connected with the lever for moving the tube rearward and forward relative to the press and blanket cylinders as the cam rotates.

6. In a printing press having a blanket cylinder and a press cylinder for printing on a continuous web that is drawn from an input region on an input side of the blanket cylinder and press cylinder to an output region on an opposite side of the input region, the press having pressure releasing means for releasing pressure between the blanket cylinder and press cylinder after printing each format, an improved feed and drive mechanism for conveying the web from the input region to the output region, comprising in combination:

an electrically actuated drive means disposed at the output region for selectively pulling the web forward from the blanket cylinder and the press cylinder;

a tube extending below the web at the input region for sliding contact with the web and having a plurality of apertures;

vacuum means for providing a vacuum to the tube;

linkage means for moving the tube rearward relative to the press and blanket cylinders while the press and blanket cylinders are in the released position to remove any slack in the web following the printing of each format, the vacuum in the tube applied to the web through the apertures causing the web to adhere to the tube during the rearward movement to the web tightening position; and wherein the tube is oriented with the apertures facing upward while the press and blanket cylinders are in the printing position and wherein the web tightening means comprises:

linkage means for moving the tube rearward relative to the press and blanket cylinders and rotating the tube a selected distance to place the apertures in a position inclined to vertical, whereby when the press and blanket cylinders begin to move the web forward again when the press and blanket cylinders are in the printing position, tension in the web will cause it to lift from the apertures to relieve the force of vacuum applied to the web.

7. In a printing press having a blanket cylinder and a press cylinder for printing on a continuous web that is drawn from an input region on an input side of the blanket cylinder and press cylinder to an output region on an opposite side of the input region, the press having pressure releasing means for releasing pressure between the blanket cylinder and press cylinder after printing each format, an improved feed and drive mechanism for conveying the web from the input region to the output region, comprising in combination:

an electrically actuated drive means disposed at the output region for selectively pulling the web forward from the blanket cylinder and the press cylinder;

a tube extending below the web at the input region for sliding contact with the web and having a plurality of apertures;

vacuum means for providing a vacuum to the tube;

means for mounting the tube rotatably to the press for allowing it to rotate in a forward direction a selected distance as the web is drawn forward by the press and blanket cylinders while in the printing position as a result of the adherence of the web to the tube because of the vacuum; and spring means for urging the tube to rotate in a rearward direction when tension in the web is released as the press and blanket cylinders move to the released position, the vacuum applied to the web through the apertures causing the tube to draw the web in a rearward direction to remove any slack in the web following the printing of each format.

8. The press according to claim 7 further comprising:

stop means for limiting the amount of forward rotation of the tube; and wherein the apertures are positioned in the tube so that at least a portion will be exposed to atmosphere when the stop means stops the forward rotation of the tube.

9. The press according to claim 7 wherein the vacuum applies a vacuum continuously to the tube both during printing position and released positions of the press and blanket cylinders.

* * * * *